US005837919A

United States Patent [19]

Yagla et al.

[11] Patent Number: 5,837,919

[45] Date of Patent: Nov. 17, 1998

[54] PORTABLE LAUNCHER

[75] Inventors: Jon J. Yagla, King George; Richard E. Miller, Jr., Fredericksburg; Robert W. Lowery, King George; John W. Powers, Falls Church, all of Va.

[73] Assignee: The United States of America as represented by the Secretary of the Navy, Washington, D.C.

[21] Appl. No.: 772,054

[22] Filed: Dec. 5, 1996

[51] Int. Cl.[6] ..... F41F 3/052

[52] U.S. Cl. ..... 89/1.816; 89/1.819; 89/1.703

[58] Field of Search ..... 89/1.816, 1.817, 89/1.81, 1.819, 1.812, 1.809, 1.8, 1.703

[56] References Cited

U.S. PATENT DOCUMENTS

| | | | |
|---|---|---|---|
| 2,925,013 | 2/1960 | Santora et al. . | |
| 2,956,478 | 10/1960 | Ream, Jr. et al. | 89/1.7 |
| 2,998,754 | 9/1961 | Bialy | 89/1.7 |
| 3,002,342 | 10/1961 | Schatzki . | |
| 3,026,775 | 3/1962 | Musser | 89/1.703 |
| 3,160,060 | 12/1964 | Zsoka et al. | 89/1.8 |
| 3,802,399 | 8/1957 | Little | 89/1.7 |
| 3,925,411 | 12/1975 | Lehmann | 89/1.81 |
| 4,796,510 | 1/1989 | Piesik . | |
| 4,802,930 | 2/1989 | Kessler | 148/671 |
| 4,934,241 | 6/1990 | Piesik . | |
| 5,012,718 | 5/1991 | Miller . | |
| 5,106,034 | 4/1992 | Yagla et al. . | |
| 5,149,906 | 9/1992 | August . | |
| 5,170,005 | 12/1992 | Mabry et al. | 89/1.81 |
| 5,194,688 | 3/1993 | Piesik . | |
| 5,473,886 | 12/1995 | Lebrun et al. . | |

FOREIGN PATENT DOCUMENTS

| | | | |
|---|---|---|---|
| 316189 | 11/1956 | Switzerland . | |
| 2124741 | 2/1984 | United Kingdom | 89/1.817 |

OTHER PUBLICATIONS

Definition for "port," and complementary; Wester's II New Riverside University Dictionary, 1994.

*Primary Examiner*—Charles Jordan
*Assistant Examiner*—Christopher K. Montgomery
*Attorney, Agent, or Firm*—James B. Bechtel, Esq.

[57] ABSTRACT

A launcher is disclosed having means for directing and concentrically spreading, as well as dispersing, exhaust gases created by an internal combustion of an object, such as a missile, that is operatively launchable therefrom. The concentric duct provides the directing, spreading and dispersing means and cooperates with a cup having means to arrange a port in operative relationship with an exhaust outlet of the object being launched. The cup which mates with the concentric duct has one of its ends open to the ambient so that the exhaust gases are lead into and out of the concentric duct so as to be concentrically dispersed into the atmosphere.

2 Claims, 4 Drawing Sheets

PORTABLE LAUNCHER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1.0) Field of the Invention

The present invention relates to a launcher for launching missiles, torpedoes, sensors, or counter measures and, more particularly, to a launcher devoid of moving parts having a concentric duct for collecting and dispersing exhaust gases produced by the launch device.

(2.0) Description of the Related Art

In addition to the harsh operational conditions involved in military applications, launchers used for launching missiles, torpedoes, sensors and countermeasures typically find themselves in environments that tend to corrode the launcher itself. In spite of such conditions, the launcher must be made operationally ready within the shortest possible time, and without the need of undue preventive maintenance. Launchers which employ moving parts hinder the obtainment of these operational readiness desires.

Existing launchers, particularly those used for shipboard applications, either use a relatively heavy plenum carrying an uptake device to capture and direct in an upward manner exhaust gases of the launched device or are lacking in a proper uptake mechanism so that the exhaust gases tend to impend on the deck of ship. None of these existing launchers satisfies the needs of shipboard launchers. It is desired to provide a launcher that does not suffer the drawbacks of prior art devices.

OBJECTS OF THE INVENTION

It is a primary object of the present invention to provide a launcher devoid of moving parts.

It is another object of the present invention to provide a launcher comprised of a material that does not suffer from corrosion, even when subjected to seawater or exhaust gases.

It is a further object of the present invention to provide a lightweight launcher so that it may be more easily handled.

Furthermore, it is an object of the present invention to provide a launcher that is arranged so that it may be easily modified to adapt to the various parameters of different missiles, torpedoes, sensors, countermeasures or other objects that are to be launched therefrom.

SUMMARY OF THE INVENTION

The invention is directed to a launcher devoid of moving parts and having a concentric duct that collects and concentrically disperses exhaust gases created by the object being launched from the launcher.

The launcher comprises first and second enclosures and a cup. The first enclosure has a wall that extends longitudinally and has interior and exterior surfaces with the interior surface encompassing and housing a launchable object having an exhaust outlet. The support means has first and second faces separated from each other by a first predetermined distance with one of faces affixed to the exterior surface of the first enclosure. The second enclosure has a wall that extends longitudinally and has interior and exterior surfaces with the interior surface affixed to the other face of the support means. The cup has a port at its central portion that is in operative relationship with the exhaust outlet of the launchable object being propelled. The cup also has a rim that mates with the wall of the second enclosure.

BRIEF DESCRIPTION OF THE DRAWINGS

A better understanding of the present invention may be realized when considered in view of the following detailed description, taken in conjunction with the accompanying drawings.

DETAILED DESCRIPTION OF THE PREFERRED EMBODIMENTS

Figure 1:
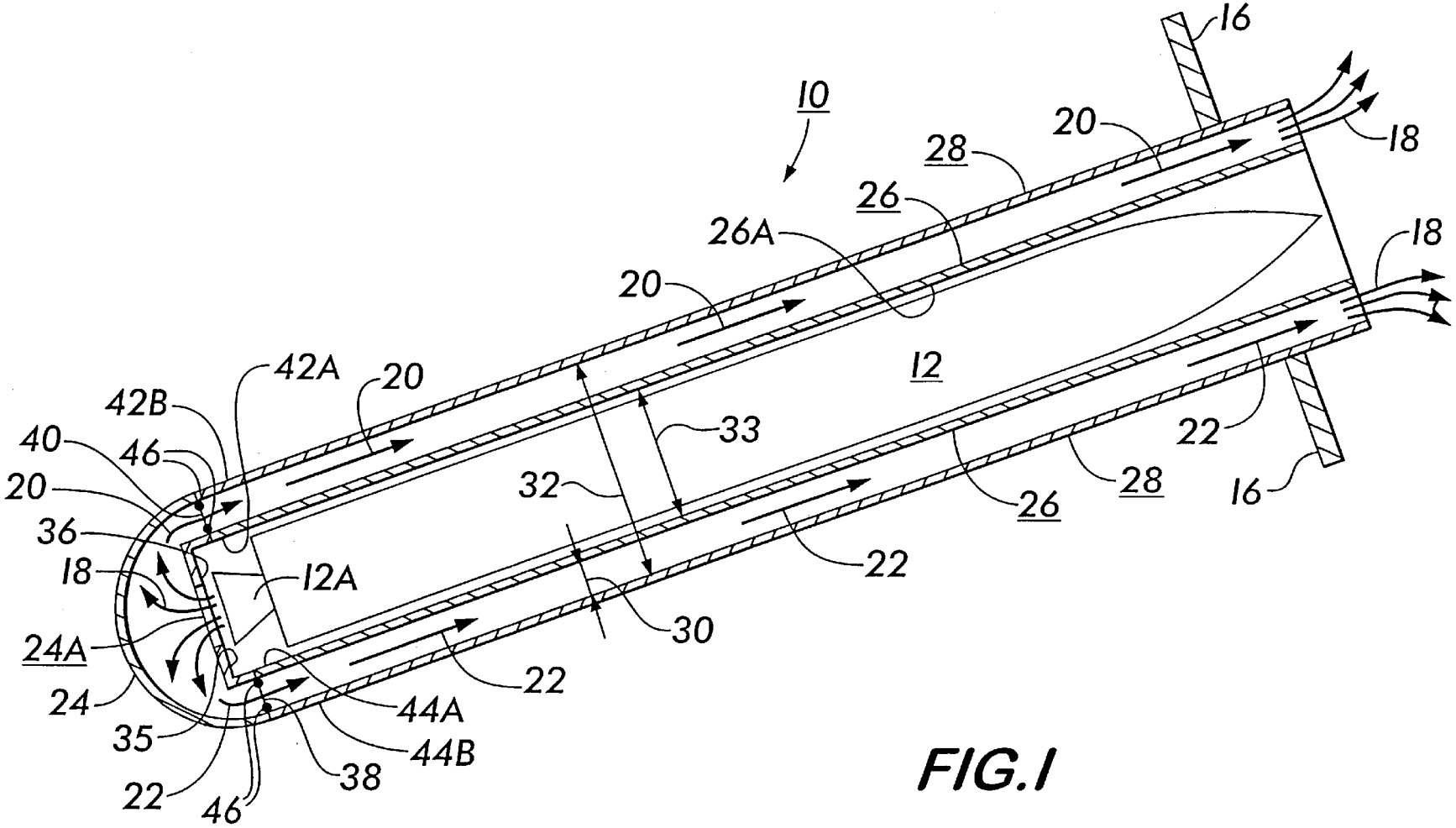
FIG. 1 is a schematic of the launcher of the present invention.

Referring to the drawings wherein the same reference number indicates the same element throughout, there is shown in FIG. 1 a launcher 10 having a concentric gas management system and having means for being flush or level shock mounted to the deck of a ship, thus, eliminating the need for a foundation level support structure while at the same time reducing the shock delivered to an object 12, such as, a missile, torpedo, sensor or countermeasures, when it is being launched out of the launcher. The concentric management system is accomplished by a concentric duct 14 that is, as seen in FIG. 1, devoid of separate plenums and uptake structures commonly found on prior art devices.

The concentric duct 14 serves as a means for collecting and dispersing exhaust gases created by the launchable object 12. The concentric duct 14 preferably comprises a titanium alloy having a trade name of TIMET 21S. The titanium alloy is advantageous because of its weight which is approximately 40% of that of stainless steel which, in turn, provides a relatively lightweight launcher 10. The titanium alloy is advantageously impervious to seawater corrosion, has high strength (140 ksi), has stiffness and a capability of withstanding high temperatures of up to 1500° F. on a continuous basis.

The concentric duct 14 is held in place by at least one plate 16 preferably comprised of the previously mentioned titanium alloy and dimensioned to snugly fit about the exterior surface of the concentric duct 14. The concentric duct 14 collects the exhaust gases, represented by directional arrows 18, generated by a launchable object 12, directs the exhaust gases 18 in an upward manner as indicated by directional arrows 20 and 22, and allows the collected exhaust gases 18 to be dispersed, in a concentric manner, from the open end of the concentric duct 14 into the ambient. The directing of the exhaust gases 18 is accomplished, in part, by a cup 24 preferably comprised of the twice mentioned titanium alloy and having a port 24A that is in operative fluid communication with a duct 12A of the launchable object 12. The port 24A allows for the egress of exhaust gases 18 created by the launchable object 12 when it is being launched. The thrust augmentation during the egress of the exhaust gases 18 is controlled by the size of the duct 12A and the port 24A.

The concentric duct 14 is formed by a first enclosure 26 and a second enclosure 28. The first enclosure 26 has a wall that extends longitudinally along the launcher 10 and has an interior surface 26A and an exterior surface 26B with the interior surface 26A encompassing and housing the launchable object 12. The second enclosure 28 has a wall that extends longitudinally along the launcher 10 and is in correspondence with the wall of the first enclosure 26. The wall of the second enclosure 28 has interior and exterior surfaces 28A and 28B respectively. The first and second enclosures 26 and 28 are spaced apart from each other by a distance 30 defined by a slat arrangement to be described with reference to FIG. 2. The opposite interior surfaces 28A are spaced apart from each other by a distance 32 and the opposite interior surfaces 26A are spaced apart from each other by a distance 34 which also corresponds to the internal bore of the launcher 10.

The cup 24 preferably has a hemispherical shape and has ledge portions 35 and 36 that are separated from each other so as to define the port 24A. The ledge portions 35 and 36 are respectively connected to stems 38 and 40 each of which is joined to the rim of the cup 24. The stems 38 and 40 are selected so as to adequately support the ledges 35 and 36 yet allow the exhaust gases 18 to pass, in directions 20 and 22, thereby to enter the space, defined by the distance 30, between the first and second enclosures 26 and 28. The cup 24, in particular its stem portions 38 and 40, mate with portions 42A and 44A of the first enclosure 26 and 42B and 44B of the second enclosure 28. The stem portions 38 and 40 may be joined to the first and second enclosures 26 and 28 by laser welds generally indicated by dots 46. Laser welding is particularly suited to the practice of the invention because the mating surfaces of the launcher 10 are primarily continuous and further details of laser welding is described in U.S. Pat. No. 5,106,034 of J. J. Yagla, et al and is herein incorporated by reference. The formation of the launcher 10 may be further described with reference to the exploded perspective view of FIG. 2.

Figures 2A, 2B, 2C, 2D, 2E:
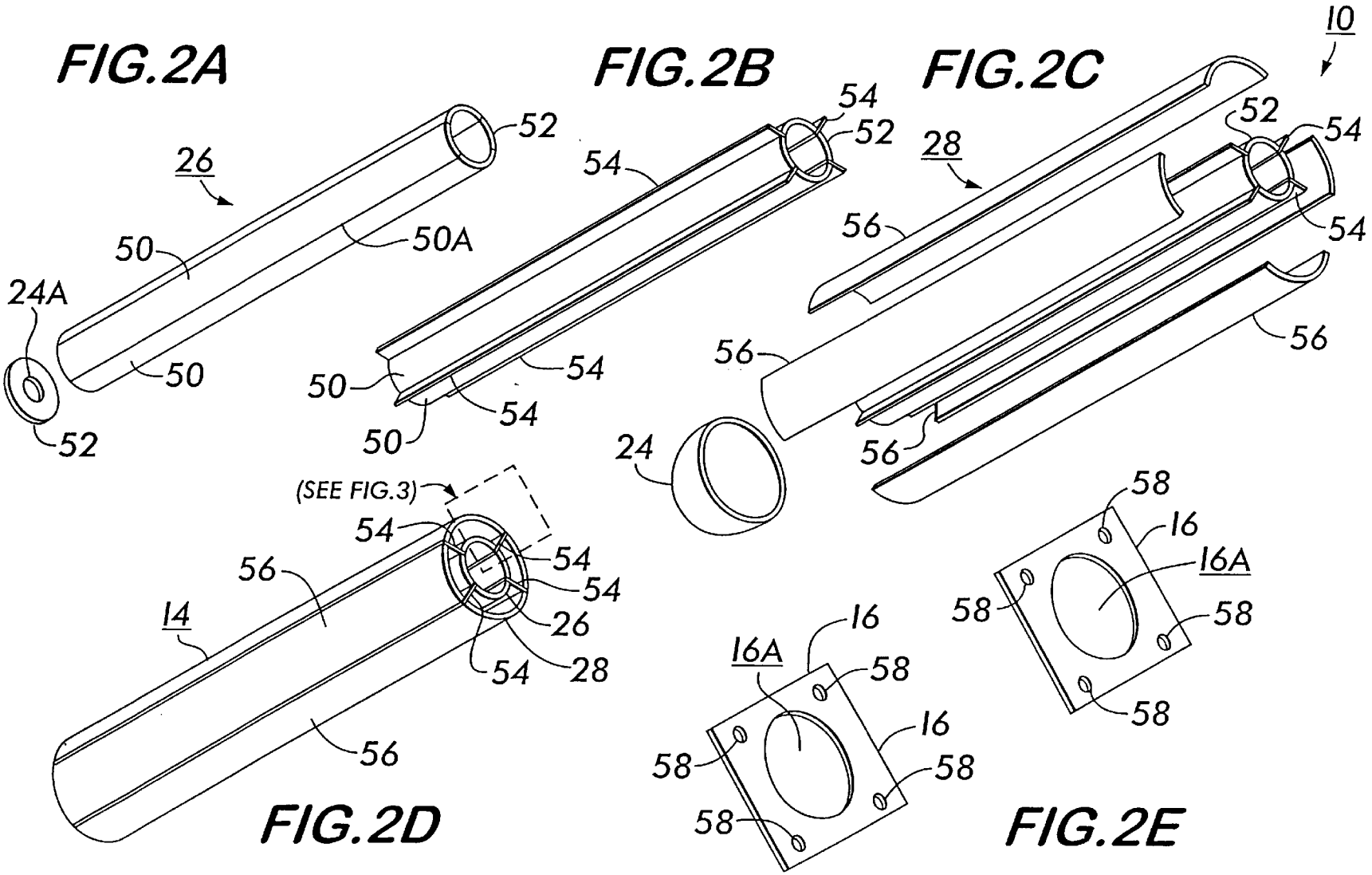
FIG. 2 is composed of FIGS. 2(A), 2(B), 2(C), 2(D) and 2(E) that cumulatively represent an exploded perspective view of the launcher of FIG. 1.

FIG. 2 is composed of FIGS. 2(A), 2(B), 2(C), 2(D) and 2(E) which cumulatively illustrate the sequential steps of forming the launcher 10. FIG. 2(A) illustrates the first enclosure 26 as being formed by a plurality of members 50, preferably four (4) members, that are held together by at least one, but preferably two (2) retaining rings 52, that respectively encompass each end of the first enclosure 26. If desired, the port 24A of cup 24, described with reference to FIG. 1, may be introduced into one of the retainers 52 as shown in FIG. 2. Further, if desired the four members 50 making up the first enclosure 26 may be separated from each other so that a gap 50A is provided therebetween which accommodates the insertion of a plurality of support members 54, preferably four (4) and arranged as shown in FIG. 2(B). Alternatively, the first enclosure 26 can be formed as a pipe or extruded so as to include the four (4) members 50 as integral parts.

The support members 54 have first and second faces with one of the faces affixed to the exterior surface of the first enclosure 26, preferably by means of the gap 50A and joined thereto by a laser weld. The other face of the support members 54 mate with a plurality of members 56, preferably four (4), which make up the second enclosure 28 as shown in FIGS. 2(C) and 2(D).

FIG. 2(C) illustrates the four preferred members 56 arranged so as to be placed into contact with the second face of the support members 54, but before such contact is accomplished, the hemispherical cup 24 is positioned in place at the bottom end, as viewed in FIG. 2(C). The four (4) support members 54 are preferably slats which serve in a similar manner as that of a longeron comprising fore-and-aft framing members of an airplane fuselage. The four (4) members 56 are merged onto the slats 54 to form the concentric duct 14 as shown in FIG. 2(D). Alternatively, the second enclosure 28 can be formed as a pipe or extruded so as to include the members 54 as integral parts. Laser welding can be used to blind-weld the support 54 members to the pipe from the outside in a manner to be described hereinafter with reference to FIG. 4.

FIG. 2(E) illustrates the oppositely disposed plates 16 as having a bore 16A which snugly fits over the outer surface of the concentric duct 14. The plates 16 further have apertures 58 which accept fastening members so that the launcher 10 may be fastened onto a structure, such as a deck or ledge of a ship, allowing the launcher member 10 to be rigidly affixed to an appropriate surface thereby allowing the launchable object, such as the missile 12 shown in FIG. 1, to be launched without delivering excessive shock thereto. Plates 16 are also provided with edge fasteners so that several launchers 10 can be ganged together for more convenient handling of a large number of weapons, or comprise a "clip" of weapons for loading into a ship.

As seen in FIG. 2, the elements 50 making up the first enclosure 26 and the elements 56 making up the second enclosure 28 are all preferably cylindrical shape, have continuous surfaces, and are relatively easily welded together by the use of laser welding. The slat members 54 serve as I-beams to improve the structural integrity of the launcher 10 and may be further described with reference to FIG. 3.

Figure 3A:
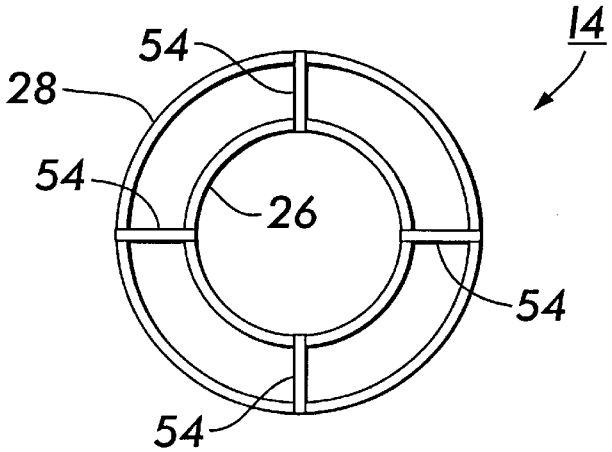
FIG. 3 is composed of FIGS. 3(A), 3(B) and 3(C) that illustrates an effective I-beam arrangement between the inner and outer side walls that form a concentric duct of the launcher of the present invention.
Figure 3B:
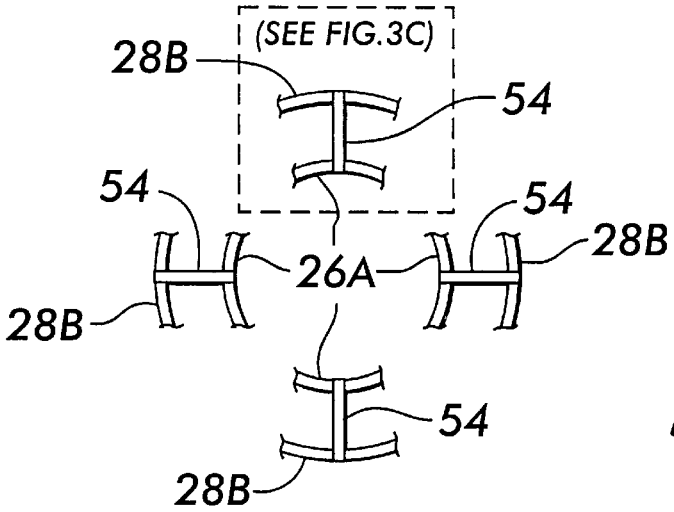
Figure 3C:
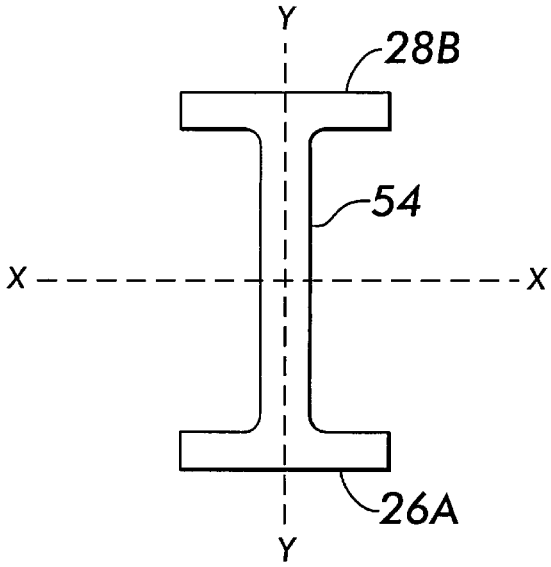

FIG. 3 is composed of FIGS. 3(A), 3(B) and 3(C). FIG. 3(A) illustrates that the slats 54 provide the means for separating the first enclosure 26 from the second enclosure 28. FIG. 3(B) shows only the portions of the first and second enclosures 26 and 28 and that the slat 54 may be equated to an I-beam analogy. FIG. 3(C) illustrates the I-beam member of the present invention formed by the slat 54 serving as the support means of the launcher 10 of FIG. 1.

FIG. 3 generally illustrates that the interrelationship between the first and second enclosures 26 and 28, wherein the slats 54 provide a cross-section which is substantially I-shape. The arrangement shown in FIG. 3 illustrates that the slat 54 serves as an I-beam that advantageously distributes the stresses that the launcher 10 encounters uniformly across the width of the I-beam.

As seen in FIG. 3(C) the width or thickness of the slat 54 serves as the web of the I-beam having a top surface 28B and a bottom surface 26A. The slat 54 is preferably comprised of titanium alloy, previously discussed for the concentric duct 14, and has a typical thickness of 0.011" to provide, in a manner known in the art, for a lightweight structure of very high bending strength. The I-beam arrangement provided by the slat 54 allows the launcher 10 to withstand relatively high stress conditions and still maintain its strength.

In operation, and with respect to FIG. 1, the launcher 10 provides for a concentric gas management of the exhaust fumes 18 by the use of the annular space, defined by distance 30 as shown in FIG. 1, between the two concentric cylinders 26 and 28 which cooperatively act as a concentric duct to discharge the exhaust fumes 18 created by the missile 12 during its firing. The exhaust fumes 18 pass from the duct 12A of the missile 12 through the port 24A (preferably of cup 24) and then against the cup 24. The exhaust gases 18 created by the missile 12 flow downward but are turned 180° by the hemispherical cup 24 and redirected, in the directions indicated by directional arrows 20 and 22, into the annular space defined by the distance 30. Thrust augmentation during egress of the exhaust gases 18 is controlled by the size of the port 24A of cup 24 and also of the duct 12A of the missile 12. The exhaust gases 18 are steered and directed through the concentric duct 14 so that they may be dispersed, in a concentric manner, from the launcher 10 from the open end of the duct 14 and into the ambient.

It should now be appreciated that the practice of the present invention provides for a relatively lightweight launcher having no movable parts and formed of a material that is relatively insensitive to corrosive conditions normally caused by seawater. The launcher of the present invention utilizes concentric gas management and has plates to allow it to be rigidly affixed to a surface to accommodate launching conditions.

Figure 4:
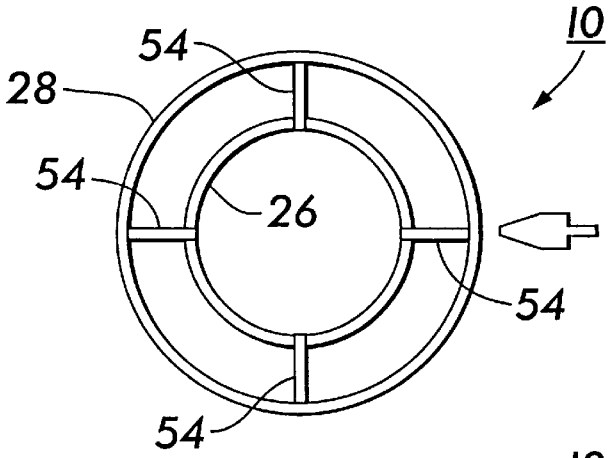
FIG. 4 is a schematic illustrating a laser source placement in a blind welding technique.
Figure 5:
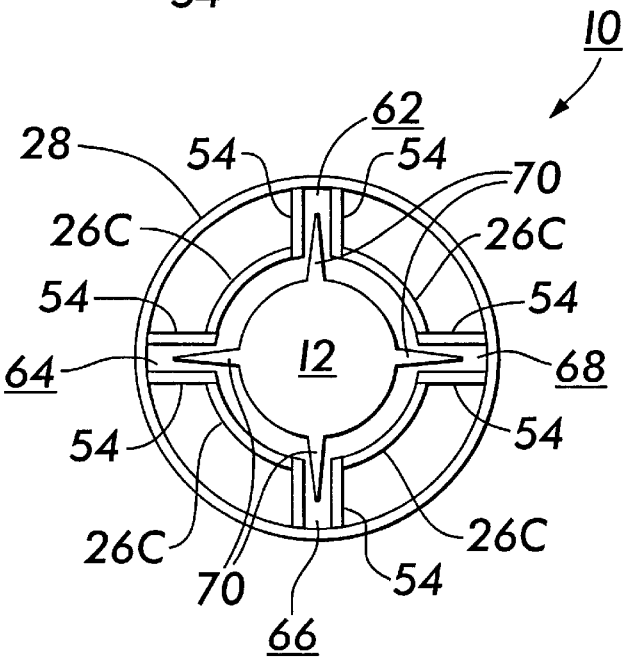
FIGS. 5 and 6 illustrate an arrangement of the inner enclosure of the launcher that accommodates various needs.
Figure 6:
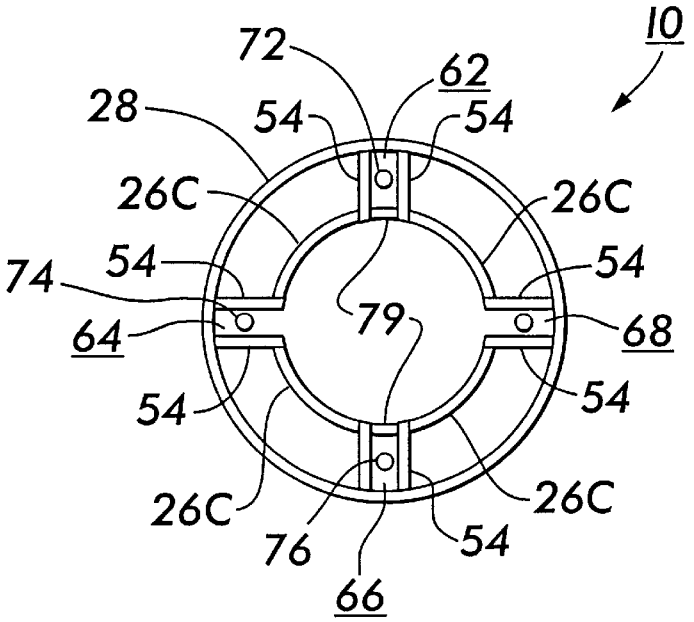

The present invention has additional embodiments shown in FIGS. 4–6 that accommodate different needs and manufacturing techniques associated with the launcher 10 such as the previously mentioned blind welding technique shown in FIG. 4.

FIG. 4 schematically illustrates the same elements already described with reference to FIG. 3(A), but in addition thereto, illustrates a laser beam 60 that is focused on and pierces the second enclosure 28 to provide for the blind welding, previously mentioned, of the slats 54 to the first and second enclosures 26 and 28.

FIG. 5 illustrates the launcher 10 as comprised of a continuous second enclosure 28 and first enclosure 26 that is comprised of sections 26C that are spaced apart from each other. FIG. 5 further illustrates that the support means 54, connecting the second enclosure 28 to the first enclosure comprised of sections 26C, comprises a plurality of slats 54 arranged into a plurality of groups with each group comprising a pair that are spaced apart from each other by a first predetermined distance. The plurality of the group of slats 54 is preferably four (4) and corresponds to the number of sections 26C. The predetermined distance between each pair of slats 54 is selected to define chambers 62, 64, 66 and 68. The chambers 62, 64, 66 and 68 are dimensioned to accommodate the different needs of the launcher 10. More particularly, as seen in FIG. 5, the chambers 62, 64, 66 and 68 are dimensioned, for one application, to accommodate the passage of fins 70 of missile 12 as the missile 12 is being launched from launcher 10.

FIG. 6 illustrates the same structural arrangement of the launcher 10 of FIG. 5, but with the missile 12 removed therefrom. More particularly, FIG. 6 illustrates the chambers 62, 64, 66 and 68 as housing devices 72, 74, 76 and 78, respectively. The devices 72, 74, 76 and 78 may be of various types. For example, device 72 may actually be an electrical cable way, device 74 may be an electronic device, device 76 may be a sprinkler for emitting fluid, such as water, and device 78 may be a duct for removing fluid. The chambers can be open as shown for chambers 64 and 68, or closed by a spectrum 79 as shown for chambers 62 and 66.

It should now be appreciated that the present invention, in addition to providing a lightweight launcher, provides a launcher that accommodates various needs for various environments in which a launcher may be used.

What we claim is:

1. A launcher having means for collecting and dispersing exhaust gases of a launchable device having an exhaust outlet, said means comprising:

a first enclosure having a wall that extends longitudinally and has interior and exterior surfaces with the interior surface encompassing and housing said launchable device;

support means comprising a plurality of slats each of which has an I-beam cross section and which serves as an I-beam member for mating with exterior and interior surfaces, said support means having first and second faces separated from each other by a first predetermined distance with one face thereof being affixed to said exterior surface of said first enclosure;

a second enclosure having a wall that extends longitudinally and has interior and exterior surfaces with the interior surface affixed to the other face of said support means; and a cup having means for arranging a port at its central portion that is in operative relationship with said exhaust outlet, said cup having a rim that mates with said wall of said second enclosure.

2. The launcher having means for collecting and dispensing exhaust gases according to claim 1, wherein said first and second enclosures, said support means, and said cup comprise titanium alloy.

* * * * *